US005666930A

United States Patent [19]

Elder

[11] Patent Number: 5,666,930

[45] Date of Patent: Sep. 16, 1997

[54] STRUCTURAL THROTTLE BODY MOUNT

[75] Inventor: Jack Edward Elder, Rochester, Mich.

[73] Assignee: General Motors Corporation, Detroit, Mich.

[21] Appl. No.: 633,247

[22] Filed: Apr. 18, 1996

[51] Int. Cl.[6] ..... F02M 25/07

[52] U.S. Cl. ..... 123/568; 123/570; 123/41.31

[58] Field of Search ..... 123/41.31, 568, 123/569, 570, 571, 184.31, 337

[56] References Cited

U.S. PATENT DOCUMENTS

| | | | |
|---|---|---|---|
| 4,072,133 | 2/1978 | McWhirter | 123/568 |
| 4,094,283 | 6/1978 | Sutton | 123/568 |
| 4,615,324 | 10/1986 | Choushi et al. | 123/568 |
| 4,811,697 | 3/1989 | Kurahashi | 123/568 |
| 5,353,767 | 10/1994 | Carbone et al. | 123/41.31 |
| 5,490,488 | 2/1996 | Aversa et al. | 123/570 |
| 5,492,104 | 2/1996 | Elder et al. | 123/568 |
| 5,542,711 | 8/1996 | Vaudry | 123/568 |

*Primary Examiner*—Willie R. Wolfe
*Attorney, Agent, or Firm*—Karl F. Barr, Jr.

[57] ABSTRACT

An intake system is disclosed for conducting air to a v-configured, internal combustion engine. The engine includes an engine coolant crossover conduit which extends between cylinder heads and has coolant passages which operate to conduct coolant therebetween. A throttle body mounting flange extends outwardly from a side of the conduit and includes a throttle body mounting surface which surrounds an opening extending through the flange. A throttle body is mounted to the throttle body mounting surface of the throttle body mounting flange with the opening of the flange aligned with the throttle body bore for conducting inlet air from said throttle body and to a conduit extending between the flange and the intake manifold of the engine. An exhaust gas passage within the engine coolant crossover conduit extends from an exhaust gas source to an outlet in the throttle body mounting flange opening which, with an associated exhaust gas metering valve, regulates the flow of exhaust gas to the outlet where it is introduced into the intake air flow passing to the intake manifold. The throttle body mounting flange operates as a sink for heat from the coolant passages in the engine coolant crossover to heat the throttle body and prevent condensation and icing.

3 Claims, 2 Drawing Sheets

STRUCTURAL THROTTLE BODY MOUNT

TECHNICAL FIELD

The invention relates to intake systems for internal combustion engines.

BACKGROUND

Trends in engine design have been driven, in part, by a desire to reduce overall vehicle weight, generally and engine component weight, specifically. Engine intake manifolds have been the focus of substantial weight reduction efforts as manufacturers have adopted the use of non-traditional, lightweight materials. Polymers such as nylon are currently used in the manufacture of several intake manifolds. Aside from the weight advantage, plastics also facilitate the molding of complex structures prevalent in high-performance applications.

Detrimental to the optimization of plastic intake manifolds are other, manifold mounted components such as the throttle body and exhaust gas recirculation valves which require special reinforcement of the manifold structure along with an attendant weight increase. For instance, as throttle activities have become increasingly automated, throttle body weight has increased dramatically. If the throttle body mass must be supported by a plastic intake manifold, the structural requirements of the manifold dictate an increase in weight without which the throttle body is subjected to substantial vibration. In the case of EGR, plastic throttle bodies may require reinforcement in the area of exhaust gas introduction due to the temperatures.

SUMMARY

The present invention is directed to an internal combustion engine intake system which facilitates the maximization of weight reduction in the intake manifold through location of the throttle body and EGR valves on a structural engine component rather than on the intake manifold as has been the case. In the preferred embodiment of the present invention, a water and exhaust gas cross over extends from one side of a v-configured internal combustion engine to the other for bank-to-bank flow of engine coolant and exhaust gas for EGR. The cross-over is provided with an integral, outwardly projecting flange member on which a throttle body is mounted. Openings in the flange member allow air flow through the throttle body, the flange member and to the intake manifold through appropriate ducting. As a result of the relocation of the throttle body to the coolant cross-over, the substantial mass of the component is transferred from the intake manifold to the engine structure allowing optimization of intake manifold size and mass and increased durability of the throttle body assembly.

An additional feature and advantage of the present invention is the delivery of the EGR feed directly to the throttle body through passages in the integral flange member on which the throttle body mounts to the coolant-EGR-crossover. External supply tubes, and associated connections, from the crossover to the manifold are eliminated as well as reinforcing assemblies which may be required when the EGR is fed directly to a plastic intake manifold.

An additional feature and advantage of the present invention is the use of direct, conductive heat transfer from the water crossover to the throttle body, due to the high heat transfer capability of the metallic crossover. By using direct heat transfer, the passages and associated plumbing which typically carry coolant to warm the throttle body can be eliminated.

An additional feature and advantage of the present invention is the application of an elastomeric duct between the opening in the flange member and the intake manifold for the transmission of air flow. The duct adjusts for tolerance stack-up between the manifold, which is located on the engine heads, and the water crossover throttle body flange which is mounted to the cylinder block and heads.

The details as well as other features and advantages of the preferred embodiment of the engine intake system employing features provided by the invention are set forth in the following detailed description and drawings.

DESCRIPTION OF THE PREFERRED EMBODIMENT

Figure 1:
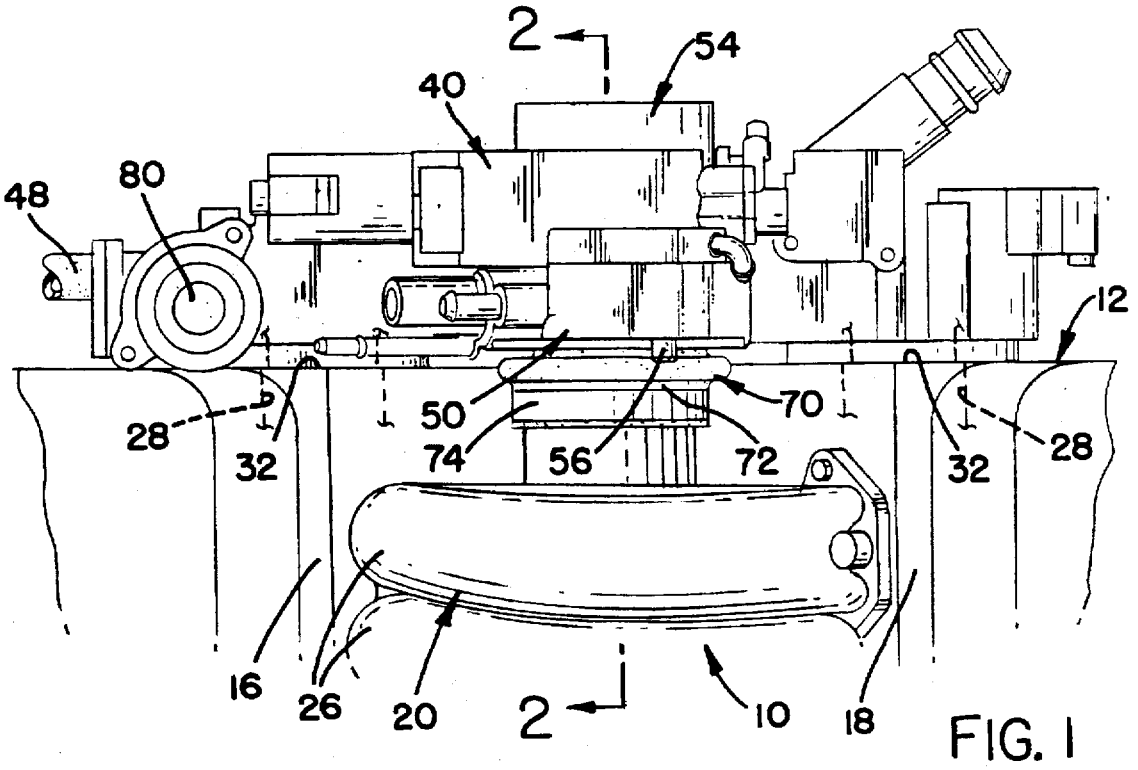
FIG. 1 is a partial plan view of an internal combustion engine embodying features of the present invention.
Figure 2:
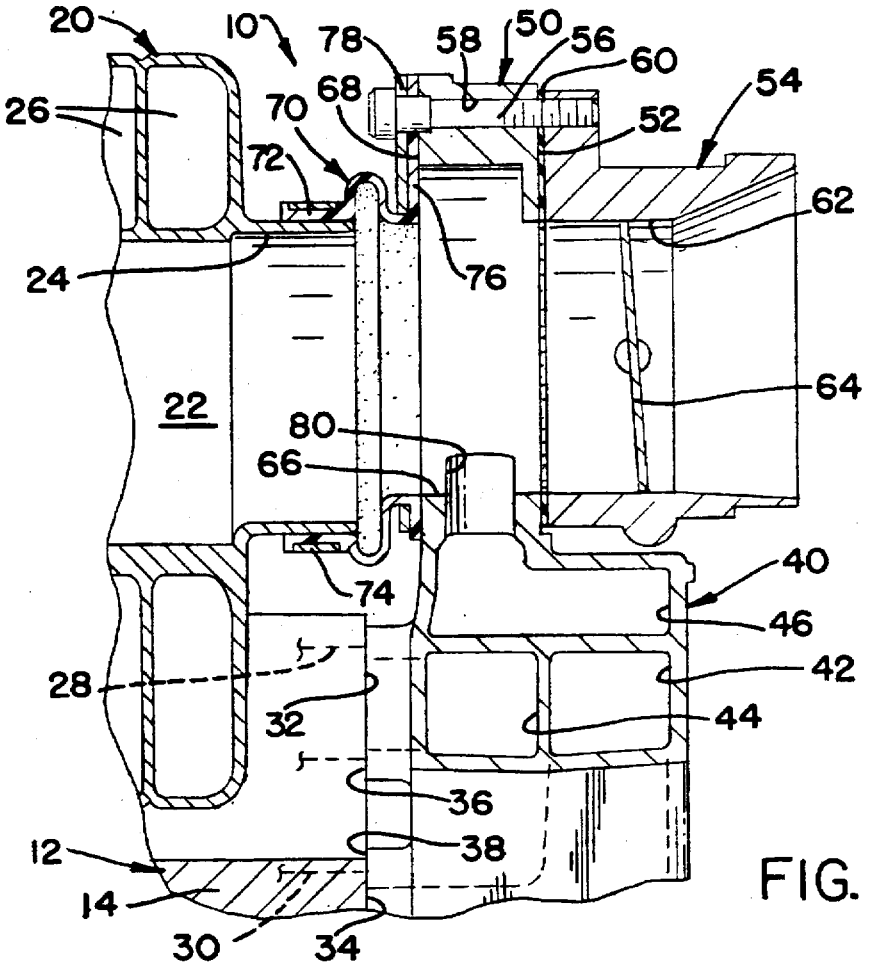
FIG. 2 is a partial sectional view of the engine of FIG. 1 taken along line 2—2.

Referring to FIGS. 1 and 2, there is illustrated a intake system, designated generally as 10, for an delivery of combustion air to the combustion chambers of an internal combustion engine 12. The engine 12 includes cylinder block 14 and heads 16 and 18. Centrally located between the heads is an intake manifold 20 having a centrally located inlet passage 22 operable to feed inlet air entering the manifold through opening 24 to individual inlet runners 26 which feed combustion air through inlet ports in the cylinder heads to each engine combustion chamber, not shown.

Figure 3:
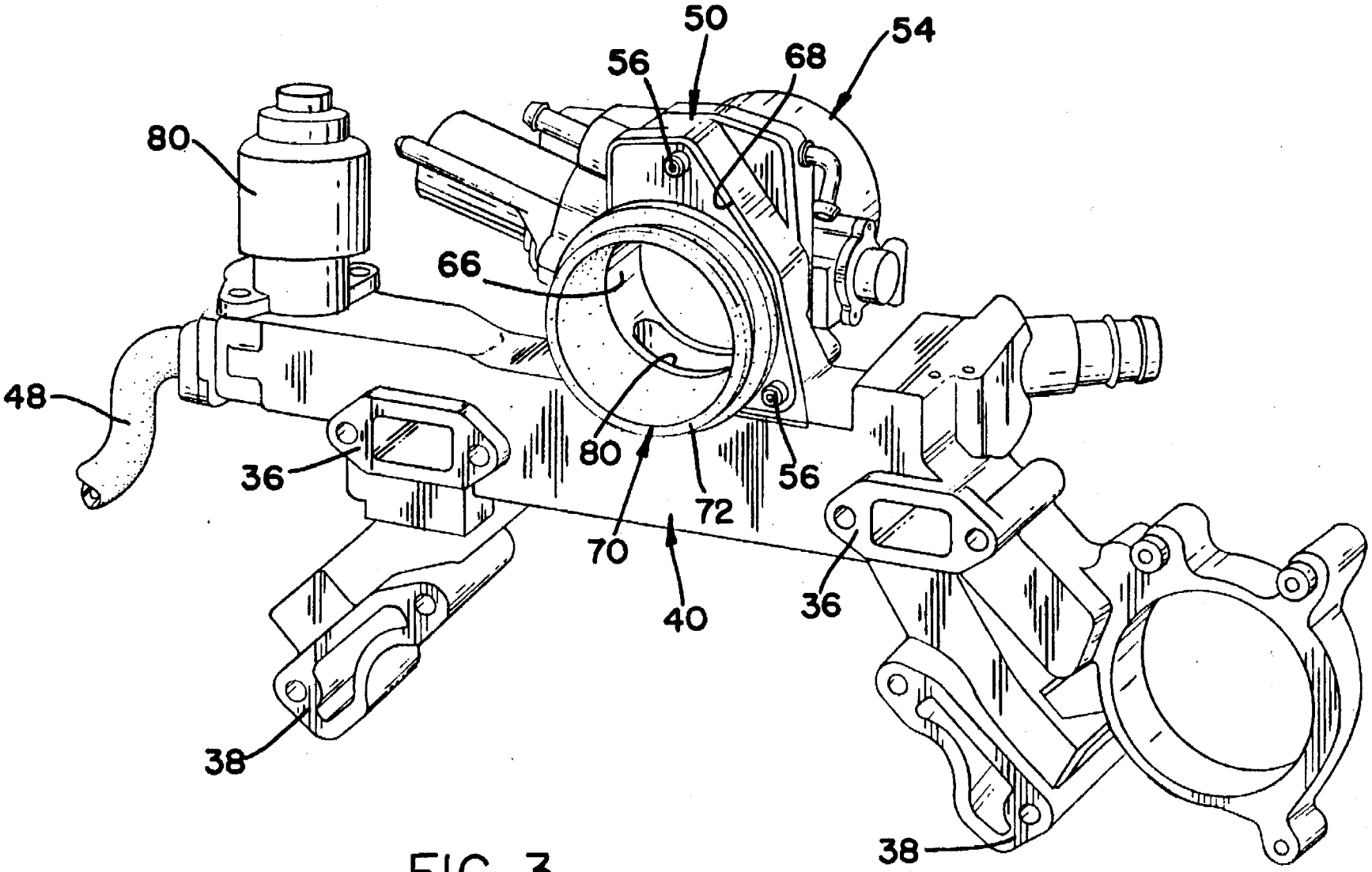
FIG. 3 is a perspective view of a component of the engine of FIG. 1 showing detail of the present invention.

Coolant openings 28 and 30 are located in the longitudinal end portions of the cylinder heads 16, 18 and engine block 12. The coolant openings are an integral part of the engine cooling system and handle the transfer of coolant to and from portions of the engine during operation. The coolant openings 28 and 30 are surrounded by flanged mounting surfaces 32 and 34 which cooperate with associated sealing surfaces 36 and 38, FIG. 3 in coolant crossover 40 to establish a leak-free seal at the interface of the components when the coolant crossover is mounted to the engine 12.

The coolant crossover 40 is preferably cast of aluminum or other structurally rigid material capable of withstanding high engine operating temperatures and preferably includes passages 44, 42 for engine block coolant and head coolant, respectively. Additionally, the crossover 40 has an internal exhaust gas passage 46 for the transfer of exhaust gas to the intake air stream, as will be further described below. The passage receives exhaust gas feed from conduit 48 which is in flow communication with a source of exhaust gas such as an exhaust gas manifold. Alternately, an opening in the cylinder head similar to that of coolant openings 28 and 30, may communicate, through the head 18, to a source of exhaust gas such as an exhaust port. In such a case, a mating opening in the crossover 40 may be used to supply the exhaust gas to the crossover exhaust gas passage 46.

A throttle body mounting flange 50 extends outwardly from the coolant crossover 40 and includes a surface 52 for mounting a throttle body 54. Throttle body 54 is mounted to the surface 52 of the mounting flange 50 using fasteners, such as bolts 56 which extend through openings 58 in the mounting flange 50. Between the base of the throttle body 54 and the mounting surface 52 of the mounting flange 50 is disposed a gasket member 60 which assures a leak free seal between the two components. The throttle body 54 includes a bore 62 in which a throttle plate 64 is rotatably mounted so as to meter the flow of intake air passing through the throttle body bore. An associated air passage 66 extends through the throttle body mounting flange 50 from the mounting surface 52 to a second surface 68. The air passage 66 is configured to allow intake air exiting the throttle body 54 to be conducted through the flange 50 and to a downstream duct or conduit 70 which is sealingly attached to the second surface 68 at the back of the throttle body mounting flange 50. As shown in FIG. 2 the downstream conduit 70 extends from the back of the throttle body mounting flange 50 to the intake air opening 24 in the intake manifold 20. The conduit 70 is preferably constructed of a flexible elastomeric material, such as rubber, enabling it to absorb manufacturing stack-up between the coolant crossover 40 and the intake manifold 20. The conduit 70 mounts to the intake manifold 20 via a snorkel type attachment 72 which requires a radial compression clamp such as band clamp 74 to establish a leak-free seal. The inlet end of the duct 70 is fixed to the throttle body flange 50 using an integrated molded seal 76 which is compressed against the surface 68 by a backing plate 78 which is held in place by the fasteners 56 used to mount the throttle body 54 to the mounting flange 50.

As described thus far, intake air is metered through the throttle body bore 62 by the rotatable throttle plate 64. Air exiting the throttle body bore, passes through the opening 66 in the throttle body mounting flange 50 where it enters flexible conduit 70 for transfer to the inlet opening 24 in the intake manifold 20. During the operation of the engine 12 it may be desirable to introduce a metered quantity of recirculated exhaust gas (EGK) to the intake air stream for purposes of managing the emission of regulated exhaust constituents from the engine. An EGR valve 80 is mounted to the coolant crossover 40 and operates to meter a desired quantity of exhaust gas from the exhaust gas conduit 48 through EGR passage 46 to an EGR outlet 80 having its terminus in the opening 66 of the throttle body mounting flange 50. Introduction of EGR adjacent the base of the throttle body 54 assures adequate mixing of the exhaust gas with the intake air charge as it flows to the intake manifold while the location of the EGR feed in the throttle body mounting flange minimizes external pluming required to deliver the gas to the intake manifold as well as eliminating the need to reinforce and insulate plastic intake manifolds at the point of exhaust gas introduction.

An important advantage to locating the throttle body mounting flange 50 on the coolant/EGR crossover 40 derives from the substantial heat conductivity inherent in the crossover material which can be utilized to heat the throttle body thus eliminating the typical throttle body coolant passages which are normally required. As hot coolant is conducted through the crossover, the outwardly extending flange member 50 operates as a heat sink to conduct heat from the coolant. Heat is transferred to the throttle body 54 at the sealing interface between the throttle body and mounting surface 52. The transfer of heat from the throttle body mounting flange 50 to the throttle body 54 operates to provide the throttle body with a level of latent heat sufficient to assure that condensation and cold weather icing is avoided. Additionally, location of the EGR conduit within the coolant/EGR crossover 40 allows for effective cooling of the exhaust gas prior to delivery to the intake through passage 80 in mounting flange 50. The lower temperature charge will rebuild in reduced levels of carbon deposit in the manifold as well as reducing charge temperatures impinging upon the plastic intake manifold 20.

The present invention provides an engine intake system in which the throttle body is removed from typical intake system mounting and located on a throttle body mounting flange which is integral with an engine coolant/exhaust gas crossover member. The location of the throttle body on the coolant/exhaust gas crossover allows the intake manifold mass to be optimized by eliminating the need for structural reinforcement to support the throttle body mass.

In addition, the throttle body mounting flange incorporates an integral EGR feed conduit which, in concert with an associated EGR valve, operates to meter recirculated exhaust gas to the intake air charge in the throttle body mounting flange opening rather that to the intake manifold. Location of the EGR feed at closely adjacent the throttle body allows for adequate mixing of the exhaust gas with the intake air stream while eliminating introduction at the intake manifold with the requirements of thermal reinforcement in the case of a plastic manifold.

The throttle body mounting flange is operable as a heat sink on the engine coolant/exhaust gas crossover which facilitates the heating of the throttle body base to prevent condensation and icing of the throttle body under certain operating conditions. The use of the throttle body mounting flange to heat the throttle body eliminates the need for external heating of the throttle body such as by separate coolant passage through the throttle body.

The foregoing description of the preferred embodiment of the invention has been presented for the purpose of illustration and description. It is not intended to be exhaustive nor is it intended to limit the invention to the precise form disclosed. It will be apparent to those skilled in the art that the disclosed embodiment may be modified in light of the above teachings. The embodiment described was chosen to provide an illustration of the principles of the invention and of its practical application to thereby enable one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

I claim:

1. An intake system for conducting air to a v-configured, internal combustion engine, said engine comprising a cylinder block, first and second cylinder heads and an engine coolant crossover conduit extending between said cylinder heads, said engine coolant crossover conduit including coolant passages operable to conduct coolant from said first cylinder head to said second cylinder head and a throttle body mounting flange extending outwardly from said conduit and including a first, throttle body mounting surface surrounding an opening extending through said flange to a second, side of said flange, said intake system further comprising an intake manifold, mounted to said cylinder block and cylinder heads and having means for distributing intake air, introduced through an inlet, to said engine, and a throttle body for metering intake air through a throttle body bore, said throttle body mounted to said throttle body mounting surface of said throttle body mounting flange, said opening of said throttle body mounting flange operable with said throttle body bore to conduct inlet air from said throttle body and to a conduit extending between said second side of said throttle body mounting flange and said inlet opening of said intake manifold, said engine coolant crossover conduit further including an exhaust gas passage extending from an exhaust gas source to an outlet in said opening of said throttle body mounting flange, said exhaust gas passage associated with an exhaust gas metering valve to regulate the flow of exhaust gas through said exhaust gas passage and to said opening, wherein said exhaust gas is introduced into the intake air flow passing through said throttle body bore and said opening in said flange for delivery to said intake manifold, and said throttle body mounting flange operable as a sink for heat from said coolant passages in said engine coolant crossover to heat said throttle body.

2. An intake system for conducting charge air to a v-configured, internal combustion engine, as defined in claim 1, said conduit extending between said second side of said throttle body mounting flange and said inlet opening of said intake manifold comprising a flexible elastomeric tube having a first, outlet end engageable with said inlet opening of said intake manifold opening and a second, inlet end having a seal member extending thereabout and engageable between said second side of said throttle body mounting flange and a backing plate fixed to said flange to define a leak-free seal for flow of air from said throttle body to said intake manifold.

3. An intake system for conducting charge air to a v-configured, internal combustion engine, as defined in claim 1, said exhaust gas metering valve fixed to said engine coolant crossover conduit and operable to regulate flow of exhaust gas through said exhaust gas passage of said conduit.

* * * * *